US005435030A

United States Patent [19]

Phillips

[11] Patent Number: 5,435,030

[45] Date of Patent: Jul. 25, 1995

[54] HINGE ADJUSTMENT AND PINTLE REMOVAL TOOL

[76] Inventor: Michael A. Phillips, 339 Canyon, St., Mammoth Lakes, Calif. 93546

[21] Appl. No.: 125,156

[22] Filed: Sep. 23, 1993

[51] Int. Cl.[6] ..... B25F 1/00

[52] U.S. Cl. ..... 7/138; 7/170; 7/166; 29/275; 29/283.5

[58] Field of Search ..... 7/138, 139, 166, 170, 7/169; 29/275, 276, 254, 283.5; 81/176.1, 176.3, 119, 186; D8/88, 89

[56] References Cited

U.S. PATENT DOCUMENTS

D. 350,270 9/1994 Jensen ..... D8/89

5,303,619 4/1994 Cole, Sr. ..... 7/170 X

*Primary Examiner*—D. S. Meislin

*Attorney, Agent, or Firm*—Leo R. Carroll

[57] ABSTRACT

A combination hinge adjustment and pintle removal tool which has the ability to perform three functions in a single wrench-shaped hand tool. A first end of the tool includes a punch tip mounted orthogonal to the longitudinal axis of the tool, which is used to initially dislodge the hinge pintle from the hinge by driving the opposite side of the tool body with a hammer. The same end of the tool also includes a cupped indentation centered colinear with the longitudinal axis of the tool. The radius of this indentation is such that it will snugly fit around the shaft of a hinge pintle beneath the head of the pintle so that it may be hammer-driven upward in order to complete removal from the hinge. The second, or opposite end of the tool includes an opening with an offset spanner tip on one of the jaws surrounding the aperture. This end of the tool is used to bend a hinge without a pintle into alignment when adjusting the door within a jam or frame. The spanner tip is disposed as an extension of the jaw side on which it is located, with an inwardly orientated jaw face which is used to contact and secure one of the hinge plates.

14 Claims, 3 Drawing Sheets

HINGE ADJUSTMENT AND PINTLE REMOVAL TOOL

BACKGROUND OF THE INVENTION

1. Technical Field

This invention relates generally to apparatus for adjustment of door hinges and more particularly to combination tools arranged to remove the hinge pintle, to adjust the alignment of the separate knuckle elements of the hinge, and finally to adjust door alignment within a door frame by bending the hinge prior to pin insertion.

2. Background Art It has often been noted that the common practice of hammering a screwdriver at variable angles under the head of a pintle pin in order to remove the pin from the hinge can result in scratched and marred woodwork, metalwork or injury to the worker. Several inventions have been made in order to lessen such damage, particularly when an old pin is partially "stuck" in the hinge.

An example of a specific Hinge Pintle Removing Tool was disclosed in U.S. Pat. No. 3,602,969 to Provost. This one piece tool has a multipurpose head on one end of a shank which provides initial separation of the pin when driven laterally, and also serves as a lifting edge to complete removal when driven longitudinally at the opposite end of the shank.

Another Hinge Pin Remover is shown by Crabbe in U.S. Pat. No. 3,689,977. Here a hammer driving tool has a V-shaped chisel blade at one end which is used to provide initial separation of the head of the pin from it's seated position. A grooved tapered shoulder is located on the tool shank below the blade end and is used to engage the pin head and complete the removal from the hinge. In U.S. Pat. No. 4,188,701, Ludwig discloses a Hinge Pin Remover which was designed to remove door hinge pins without damage to adjacent woodwork and hardware. The tool has a wedge shaped head mounted on a shank equipped with a support projection to receive the hinge. The forked end of the wedge is hammer driven laterally under the head of the hinge pin in order to provide initial upward loosening motion to the pin. The opposite end of the tool is then hammered longitudinally upward to further complete pin removal.

Prior to insertion or reinsertion of door hinge pintles through a knuckled hinge, it is necessary to obtain registration of the holes through the individual knuckles. Solutions to this problem usually involve moving the hole by striking the knuckle with a hammer, bending the knuckles by means of an external tool such as a crescent wrench or pliers, or by driving an internal tool such as a drift pin through the holes in able to force alignment. This latter approach is somewhat similar to the general problem of obtaining initial alignment of bolt holes in structural members to be mated. An example of a solution to this later problem is shown in U.S. Pat. No. 1,344,619 to Colvin, in which a separate drift bar is used to lever the drift pin into a perpendicular relationship.

It will be noted that the above patents lessen the problem of pin removal but do not address either pin insertion difficulties associated with hinge knuckle misalignment or adjustment of door alignment within a door frame prior to pin insertion.

DISCLOSURE OF INVENTION

This invention includes multiple functions in a single wrench-shaped tool. A first end of the tool includes a punch tip mounted orthogonal to the longitudinal axis of the tool. This is used to initially dislodge the hinge pintle from the hinge by driving the opposite side of the tool body with a hammer. Such a device can be carefully positioned on the pin center before striking it, and therefore avoid the scratches and marring associated with using a nail or a screwdriver blade for the same function.

The same end of the tool also includes a cupped indentation centered collinear with the longitudinal axis of the tool. The radius of this indentation is such that it will snugly fit around the shaft of a hinge pintle beneath the head of the pin. When positioned against the pin just under the top head, it may be driven upward with a hammer in order to complete removal from the hinge. Again, the hammer force is upwardly parallel with the pintle axis, thereby minimizing scarring by tool slippage.

The second, or opposite end of the tool can be used to bend individual knuckle segments of a hinge into alignment and can also be used to bend a door hinge after pintle removal in order to adjust the door within a jam or frame. This end of the tool includes an opening, similar to that of a crescent wrench, except that it also includes an offset spanner tip on one of the jaws of the crescent opening. The spanner tip is disposed as an extension of the jaw side on which it is located, with an inwardly orientated jaw face which is used to contact and secure one of the hinge plates. The jaw side on which the spanner tip is located is longer than the other jaw side, thereby producing an "overbite" on that side. When the jaws are in place around a hinge knuckle, the spanner tip is long enough to contact the hinge plate attached to the door and the door may now be levered to better fit the door jamb or frame. When compared with the similar use of an open-end wrench, the tendency to slip off and mar the hinge or the door frame has been greatly reduced.

It is a prime object of this invention to provide a tool which may be utilized to dislodge and drive a hinge pintle from a door hinge without scratching the hinge or door.

It is a further object of this invention to provide a combination tool which may also be utilized to bend a door hinge knuckle into alignment with the other knuckles of a hinge.

It is another object of this invention to provide a combination tool which may be used to adjust the alignment of the knuckles so as to adjust the door hang within a door jamb.

It is an additional object of this invention to provide a simple low cost tool which will perform the function of several separate tools.

It is an additional object of this invention to provide a combined tool which may be inexpensively manufactured, is structurally rigid and safe, and can be easily carried by a workman.

The above and other objects, features and advantages of the present invention will become more apparent from the following description when making reference to the detailed description and to the accompanying sheets of drawings in which preferred structural embodiments incorporating the principals of this invention are shown.

BEST MODE FOR CARRYING OUT THE INVENTION

Figure 1:
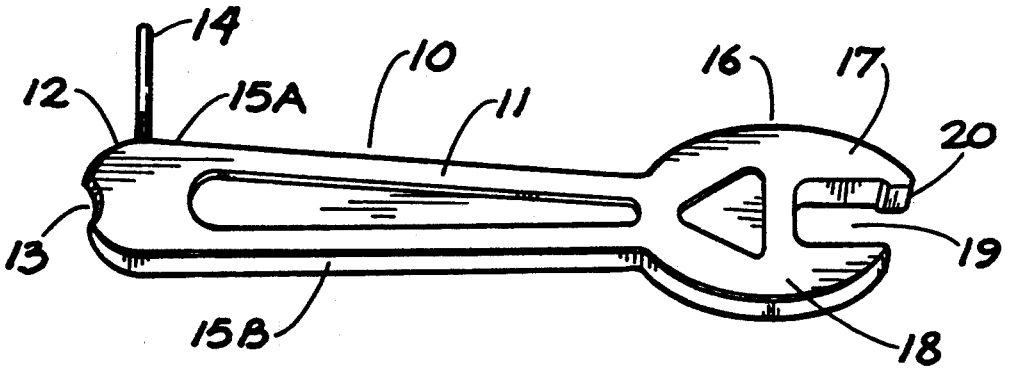
FIG. 1 is a perspective view of my invention.

With reference to the perspective view of FIG. 1, my invention is generally denoted as 10. A flattened wrench-shaped tool body 11 has a first operational end 12 which is utilized as a hingepin removal end. This end contains a cupped indentation 13 disposed with its center of radius coaxially disposed along the longitudinal axis of the tool. The radius is approximately that of a standard door hinge pintle. Hingepin removal end 12 also contains punch pin 14 which is orthogonally disposed outward from edge 15A of end 12. This pin 14 has a cylindrical shape and an outer diameter which is approximately that of the diameter of a standard door hinge pintle, and which is slightly less than the inner diameter of a standard door hinge knuckle. Although punch pin 14 is depicted as being rigidly attached to edge 15A, in the interest of obtaining a fiat package it may also be made as a separate piece which is pressed into a corresponding aperture in edge 15A.

Tool body 11 also has a second operational end 16 opposite end 12, which is utilized as a hinge bending wrench end. This end 16 is generally shaped like an open-end wrench, having a pair of jaws 17 and 18 defining an open aperture 19. One of the jaws 17 includes an inwardly directed spanner tip 20 with a length which reaches beyond the longitudinal extent of opposite jaw 18.

Figure 2:
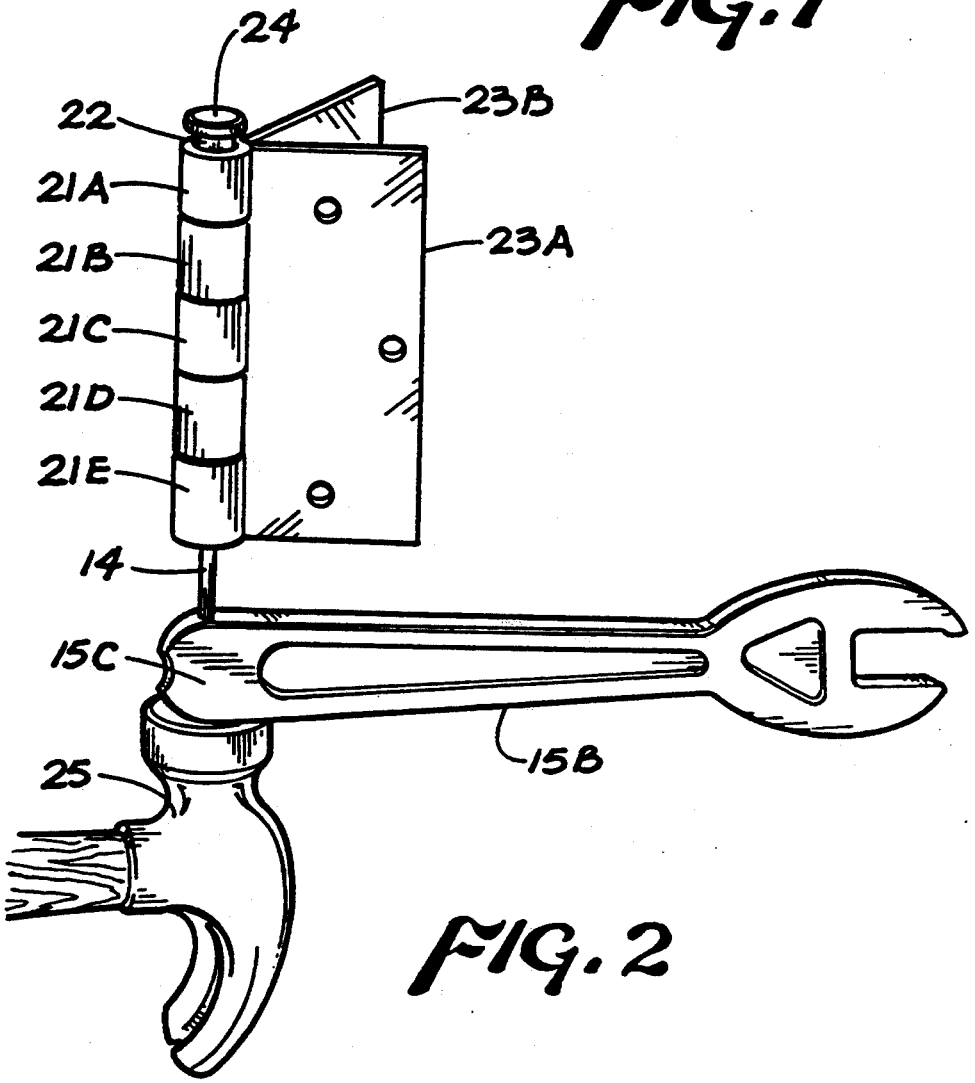
FIG. 2 is a side perspective view of my invention illustrating the position of the tool when initially dislodging the pintle in a work piece hinge.

FIG. 2 shows an operational view of my tool being used to initially dislodge a pintle 22 from the aligned hinge knuckles 21 of a butt-type door hinge 23. Knuckles 21A, 21C, and 21E are attached to the door half 23A of hinge 23, while knuckles 21B and 21 D are attached to the door frame half 23B of hinge 23. Tool punch 14 is aligned with the lower end (not shown) of pintle 20 opposite pintle head 24. Opposite tool edge 15B is then struck with hammer 25. Hammer 25 can provide the considerable force often necessary to overcome the stitching of an older painted and rusted pintle stuck within the bent knuckles 21 of an old door hinge. Such a force is best applied coaxially to the pintle rather than trying to wedge a tool blade obliquely under the top head 24 of pintle 22.

Figure 3:
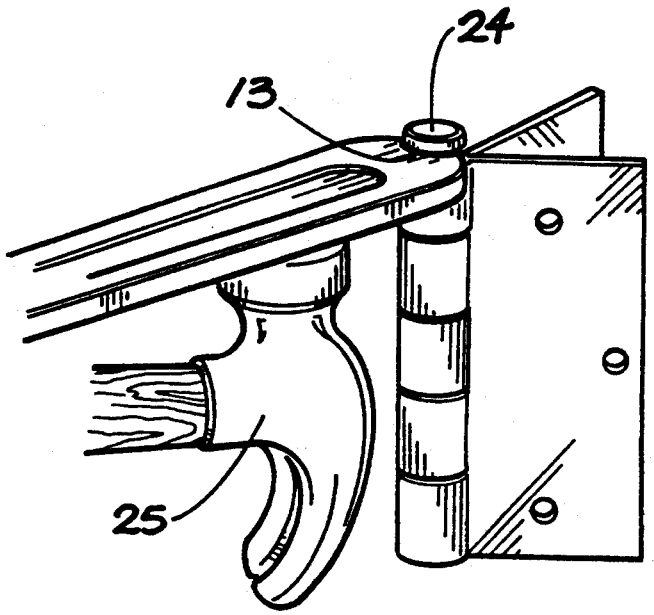
FIG. 3 is a side perspective view of my invention illustrating the position of the tool when removing the pintle from a work piece hinge.

FIG. 3 illustrates the use of the tool to further drive pintle 22 from the door hinge 23. After pintle 22 has been dislodged as in FIG. 2 by an axial distance greater than the thickness of my tool, the cupped portion 13 of removal end 12 may be used to embrace pintle 22 just below pintle headcap 24. The fiat surface 15C of the tool may now be struck with hammer 25 in order to drive the pintle 22 completely out of hinge 23. Again the force is applied axially to the pin, thereby avoiding the scratching commonly associated with slippage of a screwdriver type tool used to obliquely drive the pintle head upward.

Figure 4:
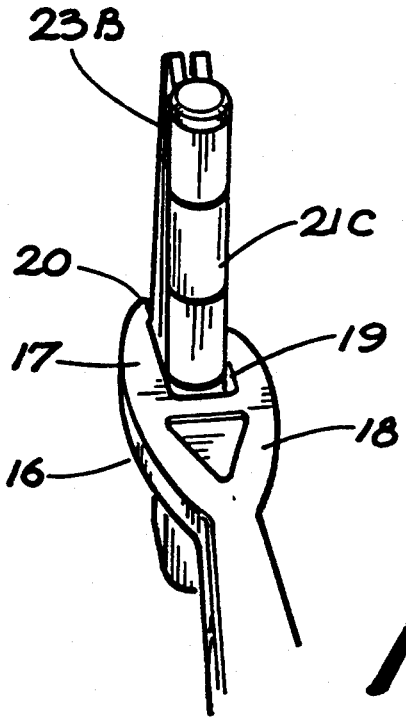
FIG. 4 is a front perspective view of my invention illustrating the position of the tool when aligning a knuckle in a work piece hinge.
Figure 5:
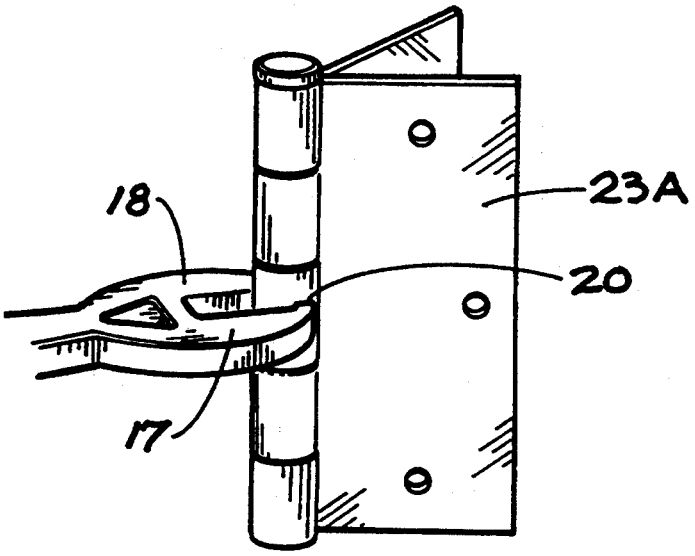
FIG. 5 is a side perspective view of my invention illustrating the position of the tool when bending a hinge to adjust the fit of a door within a door jamb.

The opposite wrench end of my handtool may be utilized to adjust individual knuckles of an unassembled hinge into alignment with the other knuckles, and in addition it may be used to adjust an assembled hinge to improve door fit within a door jamb. FIGS. 4 and 5 illustrate this latter use with an alternate embodiment of the opposite wrench end 16 of my tool. In this example, the inner surface of the jaws 17 and 18 are curved in order to provide increased surface contact with the curved knuckle. In either the curved or straight jaw cases, the inner surface of each jaw may be plastic coated in order to prevent hinge damage. FIG. 4 shows an end elevation view of aperture 19 of wrench end 16 engaging hinge knuckle 21C of an assembled hinge with hinge pintle 22 removed. FIG. 5 shows a side elevation view with the wrench turned over. Referring to FIG. 4, wrench jaw 17 spans around hinge knuckle 21C and tip 20 bears upon hinge side 23B which is attached to the door. When so engaged, the hinge may be bent so as to push or pull the door within its jamb or frame in order adjust the door fit. By bending the door portion of the hinge outward toward the door knob, the door may be pushed closer to the frame on the knob side. If the jamb attached portion of the hinge is bent toward the knob, the door will be pulled back closer to the hinge side. After the door fit is adjusted, the pintle may be replaced in the hinge and the door will remain in this new position within the frame.

The basic concepts and apparatus for providing a combination tool for both hinge pin removal and for hinge bending have been illustrated herein. Although the present invention has been described in considerable detail with reference to certain preferred embodiments thereof, other versions are possible. Therefore, the spirit and scope of the appended claims should not necessarily be limited to the description of the preferred versions contained herein.

What is claimed is:

1. A combination handtool for removing a head capped hinge pintle from a knuckled door hinge and for bending adjustment of the door hinge comprising:

an elongated handle body having first and second opposite flattened ends thereon, each flattened end having first and second edges thereon;

hinge pintle extraction means disposed on said first end of said body, said extraction means comprising:

punch means including a cylindrical pin having an outer diameter less the inner diameter of said hinge knuckles, said pin being affixed to and orthogonally disposed outward from said first edge of said first flattened body end so that said pin can engage, dislodge, and move said hinge pintle within said door hinge so as to separate the pintle headcap from the adjacent hinge knuckle by a distance sufficient to pass the flattened end of said body thereunder when said first flattened body end is hammer driven by blows applied to said second edge; and pintle removal means for completion of pintle extraction after initial movement of said pintle within said door hinge; and hinge wrenching means disposed on said second end of said body for bending engagement with said knuckled door hinge so that the fit of a hinged door within its door frame may be adjusted after removal of said hinge pintle.

2. A combination tool as recited in claim 1 wherein said cylindrical pin is removably attached to said first edge of said first body end.

3. A combination tool as recited in claim 2 wherein said pintle removal means for completion of pintle extraction consists of a cupped indentation on said first flattened end of said body disposed between said first and second edges thereon and centered colinear with the longitudinal axis of the tool, said indentation having a radius approximately equal to that of said pintle so that when said indentation is placed around said pintle under said headcap said pintle will be driven out of said hinge when the said flattened tool body is hammered in the extracting direction.

4. A combination tool as recited in claim 1 wherein said hinge wrenching means includes a pair of jaws forming an open-ended aperture for close bending embrace of a hinge knuckle.

5. A combination tool as recited in claim 4 wherein said pair of jaws further comprises:

a first fiat top and fiat bottom surfaced jaw having a first curved outer edge surface and a first inner edge surface defining a first side of said aperture, said first curved outer edge surface intersecting said first inner edge surface at a tip line orthogonal to said first fiat top and fiat bottom surfaces; and a second fiat top and fiat bottom surface jaw having a second curved outer edge surface and a second inner edge surface defining a second side of said aperture opposite and longer than said first side of said aperture, said second curved outer surface having a radius of curvature greater than the radius of curvature of said first outer edge surface such that said second curved outer edge surface intersects said second inner edge surface at a second tip line orthogonal to said second fiat top and fiat bottom surfaces, said second tip line being longitudinally extended beyond said first tip line.

6. A combination tool as recited in claim 5 further comprising a spanner tip portion of said second jaw extending longitudinally inward from said second tip line to a line approximately opposite said first tip line, both said second lines combining with second top and bottom edge lines to define a rectangular lip which will bear on said door hinge beyond the connecting line of a hinge knuckle to said door hinge.

7. A combination tool as recited in claim 6 wherein said rectangular lip on said second jaw is further disposed inwardly toward said first jaw so as to reduce the entrance area of said aperture defined by both said jaws.

8. A combination tool as recited in claim 7 wherein each said jaw further includes curved inner surfaces, each said inner surface having a radius of curvature less than the radius of curvature of its associated outer surface.

9. A combination tool as recited in claim 8 wherein said jaws are adjustably disposed toward each other in order to adjust the width of said aperture.

10. A combination tool as recited in claim 6 wherein each said jaw further comprises protective means to prevent marring contact between said jaws and said door or hinge surfaces.

11. A combination tool as recited in claim 10 wherein said protective means consists of a plastic coating on all wrench contact surfaces.

12. A combination handtool for removing a head capped hinge pintle from a knuckled door hinge and for bending adjustment of the door hinge comprising:

an elongated handle body having first and second opposite flattened ends thereon, each flattened end having first and second edges thereon;

pin punch means for initial dislodging and movement of said hinge pintle within said door hinge so as to separate the pintle headcap from the adjacent hinge knuckle by a distance sufficient to pass the flattened end of said body thereunder, said pin punch means having an outer diameter less the inner diameter of said hinge knuckles, said pin being affixed to and extending from said first body end so that said pin can engage and dislodge said pintle when said first flattened body end is hammer driven;

pintle removal means for completion of pintle extraction consisting of a cupped indentation on said first flattened end of said body disposed between said first and second edges thereon and centered colinear with the longitudinal axis of the tool, said indentation having a radius approximately equal to that of said pintle so that when said indentation is placed around said pintle under said headcap said pintle will be driven out of said hinge when the said flattened tool body is hammered in the extracting direction; and hinge wrenching means disposed on said second end of said body for bending engagement with said knuckled door hinge so that the fit of a hinged door within its door frame may be adjusted after removal of said hinge pintle.

13. A combination handtool for removing a head capped hinge pintle from a knuckled door hinge and for bending adjustment of the door hinge as recited in claim 12, wherein said hinge wrenching means comprises:

a first fiat top and fiat bottom surfaced jaw having a first curved outer edge surface and a first inner edge surface defining a first side of said aperture, said first curved outer edge surface intersecting said first inner edge surface at a tip line orthogonal to said first fiat top and fiat bottom surfaces; and a second fiat top and fiat bottom surface jaw having a second curved outer edge surface and a second inner edge surface defining a second side of said aperture opposite and longer than said first side of said aperture, said second curved outer surface having a radius of curvature greater than the radius of curvature of said first outer edge surface such that said second curved outer edge surface intersects said second inner edge surface at a second tip line orthogonal to said second fiat top and fiat bottom surfaces, said second tip line being longitudinally extended beyond said first tip line.

14. A combination handtool for removing a head capped hinge pintle from a knuckled door hinge and for bending adjustment of the door hinge as recited in claim 13, further comprising:

a spanner tip portion of said second jaw extending longitudinally inward from said second tip line to a line approximately opposite said first tip line, both said second lines combining with second top and bottom edge lines to define a rectangular lip which will bear on said door hinge beyond the connecting line of a hinge knuckle to said door hinge.

* * * * *